US007731167B2

(12) United States Patent
Prim et al.

(10) Patent No.: US 7,731,167 B2
(45) Date of Patent: Jun. 8, 2010

(54) METHODS AND SYSTEMS FOR CONTROLLING THE FEEDING OF STACKED SHEET MATERIAL

(75) Inventors: John E. Prim, West Chazy, NY (US); David F. Hall, Plattsburgh, NY (US); Berend Doane, New Haven, VT (US)

(73) Assignee: Prim Hall Enterprises, Inc., Plattsburgh, NY (US)

( * ) Notice: Subject to any disclaimer, the term of this patent is extended or adjusted under 35 U.S.C. 154(b) by 614 days.

(21) Appl. No.: 11/565,996

(22) Filed: Dec. 1, 2006

(65) Prior Publication Data

US 2008/0128983 A1 Jun. 5, 2008

(51) Int. Cl.
*B65H 39/00* (2006.01)

(52) U.S. Cl. ..... 270/52.22; 270/52.14; 270/52.16; 270/52.2; 270/52.21; 271/146; 271/264.04; 271/270

(58) Field of Classification Search ..... 270/52.14, 270/52.16, 52.2, 52.21, 52.22; 271/146, 271/265.04, 270
See application file for complete search history.

(56) References Cited

U.S. PATENT DOCUMENTS 4,903,600 A * 2/1990 Long ..... 101/485
5,088,711 A * 2/1992 Newsome ..... 270/52.14
5,833,226 A * 11/1998 Claassen ..... 270/52.16
5,833,229 A 11/1998 Prim ..... 271/11
6,193,229 B1 2/2001 Hall et al. ..... 271/109
6,623,000 B2 9/2003 Hall ..... 271/11
6,695,304 B1 * 2/2004 Werner ..... 271/146
7,014,184 B2 3/2006 Hall et al. ..... 271/3.02
7,287,748 B2 * 10/2007 Maeder et al. ..... 270/52.05
2005/0085943 A1 * 4/2005 Maeder et al. ..... 700/220
2007/0069442 A1 * 3/2007 Abegglen ..... 270/52.14
2008/0048379 A1 * 2/2008 Desfosses ..... 270/52.16

OTHER PUBLICATIONS

U.S. Appl. No. 11/544,767, filed Oct. 31, 2006, Hall.

* cited by examiner

*Primary Examiner*—Gene Crawford
*Assistant Examiner*—Leslie A Nicholson, III
(74) *Attorney, Agent, or Firm*—Helsin Rothenberg Farley & Mesiti P.C.

(57) ABSTRACT

Methods and systems employing belt conveyors adapted to feed signatures to a collating conveyor and a control system that regulates the operation of the belt conveyors are provided. The control system is adapted to regulate the speed of the belt conveyors in response to the speed of the collating conveyor, for example, proportional to the speed of the collating conveyor, to minimize or eliminate signature misfeeds. The control system may implement a mathematical algorithm that defines a relationship between the collating conveyor speed and the belt conveyor speeds. The systems and methods may include ancillary feeding devices such as joggers and speeder wheels to optimize the transfer of signatures.

22 Claims, 3 Drawing Sheets

METHODS AND SYSTEMS FOR CONTROLLING THE FEEDING OF STACKED SHEET MATERIAL

TECHNICAL FIELD

The present invention relates to sheet material handling systems and methods, and more particularly to systems and methods for controlling the operation of individual conveyors in signature feeding systems in response to variations in the speed of the collating conveyor to which the signatures are being fed.

BACKGROUND OF THE INVENTION

The binding and printing industries often rely on high-speed sheet material handling systems for printing, collating, binding, and otherwise handling sheet material, for example, sheets of paper. This sheet material, for example, individual sheets, newspapers, magazines, inserts and "onserts" (that is, sheet material used when collating newspapers), free-standing inserts (FSIs), books, brochures, and the like, is typically, fed to and accumulated in containers or "magazines" or "hoppers" and withdrawn from the magazines or hoppers and forwarded to a collating conveyor. One particular sheet material that is handled in the binding and printing industry is what is known in the art as a "signature." A signature typically comprises two or more sheets of paper that may be folded to form a spine, that is, a "spine fold." Signatures may contain four or more pages of text or graphics, for example, 30 or more pages of text or graphics.

In the manufacture of books or the assemblage of newsprint, it is common to assemble the book on a collecting or collating conveyor by sequentially withdrawing signatures from magazines, or hoppers, containing stacks of signatures. In producing a book, typically, a plurality of serially arranged hoppers, separating devices, and feeders are employed for gathering and collating the printed sheets of, for example, signatures. Typically, the separating devices separate and withdraw the sheet material from the hoppers and feed the sheet material to a rotating drum. The rotating drum then feeds the sheet material to a conveyor that collects and transfers the separated printed sheets for collation, binding, or other handling. The separation of the sheet material from the stacked sheet material is typically effected by a rotating disk separator. One typical disk-type separator is disclosed in U.S. Pat. No. 6,193,229, the disclosure of which is incorporated by reference herein in its entirety. The disk separator separates and feeds the sheet material to a rotating drum that accepts and retains the sheet material and conveys it to the conveyor. The conveyor that receives the sheet material is typically a horizontal conveyor. This horizontal conveyor may also receive sheet material from other, typically serially positioned, feeding drums.

The hoppers from which the rotating drum conveyor withdraws signatures is typically fed by one or more conveyors, for example, one or more conveyors upon which signatures are mounted, for instance, manually or automatedly, which convey the signatures to the hoppers. The timing of feeding and transferring of signatures from conveyor to hopper, from hopper to feeder, and from feeder to collating conveyors is often critical to the proper operation of the feeder and the proper assembly of the signatures on the collating conveyor. Misfeeds and jamming may occur when the timing of feeding and conveying is not optimum, for example, signatures may back up on a conveyor that feeds too quickly or a hopper may be depleted when a conveyor is not operated fast enough.

Aspects of the present invention address the disadvantages of prior art signature feeding and conveying systems by relating the speed of conveyors to the speed of the collating conveyor whereby backups and jamming of signatures during convey are minimized or even eliminated.

SUMMARY OF THE INVENTION

In response to the recognized disadvantages of the prior art, the inventors conceived and developed the present invention as described below. One aspect of the invention is a system for loading signatures on to a collating conveyor, the system including a first belt conveyor (sometimes referred to as the "infeed conveyor"); a second belt conveyor (sometimes referred to as the "incline conveyor") positioned to receive signatures from the first belt conveyor and discharge the signatures to a hopper; a feeder adapted to transfer signatures from the hopper to the collating conveyor; and a control system adapted to control the speed of at least one of the first belt conveyor and the second belt conveyor in response to the speed of the collating conveyor to minimize misfeeding of signatures. In one aspect, the control system is adapted to regulate the speed, $S_C$, of one of first conveyor or the second conveyor according to the relationship $S_C = K \times S_{CC}$, where K is a constant.

Another aspect of the invention is a method for loading signatures on to a collating conveyor, the method including conveying signatures from a signature loading position using a first conveyor to a second conveyor; conveying the signatures with the second conveyor to a hopper; transferring the signatures from the hopper to the collating conveyor; and controlling the speed of at least one of the first conveyor and the second conveyor in response to the speed of the collating conveyor to minimize misfeeding of signatures.

A further aspect of the invention is a system for loading signatures on to a collating conveyor, the system including a first belt conveyor; a first variable speed drive system adapted to move the first belt conveyor; a second belt conveyor positioned to receive signatures from the first belt conveyor and discharge the signatures to a hopper; a second variable speed drive system adapted to move the second belt conveyor; a speeder wheel positioned above the second belt conveyor adapted to discharge signatures from the second belt conveyor to the hopper; a hopper jogger adapted to agitate signatures in the hopper; a feeder adapted to transfer signatures from the hopper to the collating conveyor; and a control system adapted to control a speed of at least one of the first conveyor and the second conveyor proportional to a speed of the collating conveyor to minimize misfeeding of signatures.

These and other aspects, features, and advantages of this invention will become apparent from the following detailed description of the various aspects of the invention taken in conjunction with the accompanying drawings.

BRIEF DESCRIPTION OF THE DRAWINGS

The subject matter, which is regarded as the invention, is particularly pointed out and distinctly claimed in the claims at the conclusion of the specification. The foregoing and other objects, features, and advantages of the invention will be readily understood from the following detailed description of aspects of the invention taken in conjunction with the accompanying drawings in which:

DETAILED DESCRIPTION OF THE INVENTION

Figure 1:
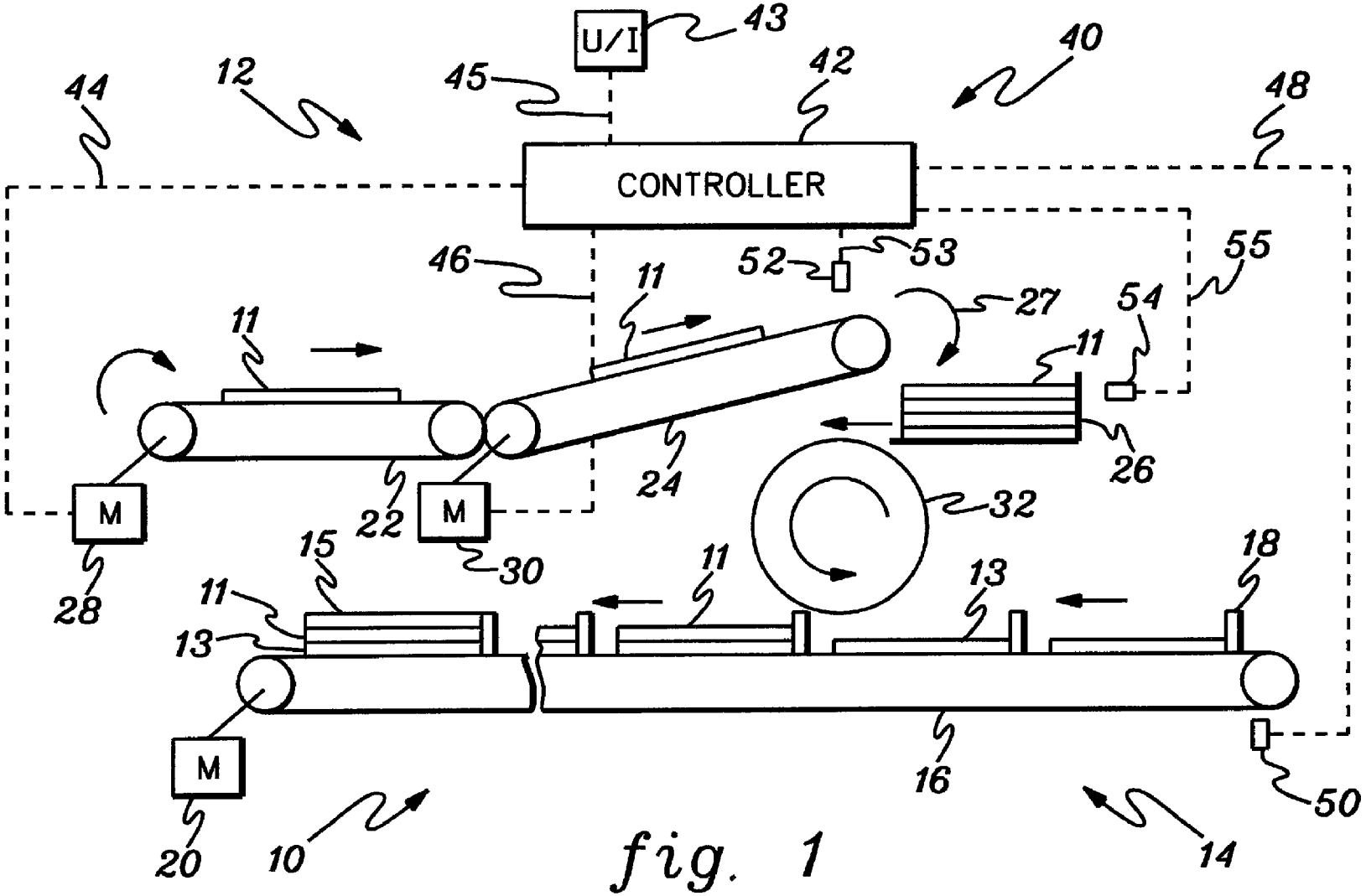
FIG. 1 is a schematic illustration of an automated signature handling system according to one aspect of the invention.

FIG. 1 is a schematic illustration of an automated signature handling system 10 according to one aspect of the invention. Though the following description, and the attached claims, may use the term "signature" almost exclusively when referring to the sheet material being handled, it will be understood by those of skill in the art that aspects of the invention may be applied to the handling of any sheet material, including, but not limited to, individual sheets, newspapers, magazines, inserts, onserts, FSIs, books, brochures, packages, and the like.

In system 10, signatures 11 are typically transferred from a feed system 12 to a conveyor 14, for example, a collating conveyor. Conveyor 14 typically includes a conveying belt or chain 16 having a plurality of pusher pins or posts 18, for example, as disclosed in copending U.S. application Ser. No. 11/554,767 filed on Oct. 31, 2006. Conveyor chain or belt 16 conveys the signatures 11 to the desired destination, for example, to a binding machine (not shown). Chain 16 is typically driven by one or more motors 20. Conveyor 14 may be a gatherer or collating conveyor provided by Prim Hall of Plattsburgh, N.Y., though other conveyors may be used in aspects of the invention.

Signature feed system 12 typically includes at least one conveyor, but typically, at least two conveyors 22 and 24. Conveyors 22 and 24 are positioned and adapted to receive signatures 11, for example, on conveyor 22, and transfer signatures 11 to a hopper 26, as indicated by arrow 27. Conveyors 22 and 24 may be conventional belt conveyors driven by conventional motors 28 and 30, respectively. According to the present invention, at least one of the motors 28 and 30 is a variable speed motor, but typically both motors 28 and 30 are variable speed motors, whereby the speed of transfer of conveyors 22 and 24 may be varied.

Hopper 26 may be a conventional hopper adapted to receive signatures 11 from conveyor 24. Hopper 26 is typically positioned to transfer signatures 11 to drum conveyor 32. Hopper 26 may include a floating back guide as disclosed in U.S. Pat. No. 7,014,184, the disclosure of which is incorporated by reference herein. Drum conveyor 32 typically is fed by a disk feeder (not shown), for example, the disk feeder and drum conveyors illustrated in U.S. Pat. Nos. 6,623,000 and 5,833,229 (the disclosures of which are included by reference herein) and transfers signatures 11 to conveyor 14. Though a single feed system 12 and drum conveyor 32 is shown in FIG. 1, conveyor 14 may be fed by a plurality of feed systems 12 and drum conveyors 32, as is conventional. For example, drum conveyor 32 may place signatures 11 on one or more existing signatures 13 already positioned on conveyor 14, for instance, positioned by an upstream drum conveyor similar to drum conveyor 32. Similarly down stream conveyors may locate additional signatures 15 on top of signatures 11 as shown in FIG. 1.

According to aspects of the present invention, system 10 also includes a control system 40. Control system 40 is adapted to control and regulate the operation of the devices in system 10 to maximize throughput, for example, by minimizing or preventing signature jams and signature misfeeds. Control system 40 includes a control unit 42 and an array of monitoring and control devices adapted to monitor and/or control the operation of the devices in system 10. Control unit 42 may be, for example, a computer, programmable logic controller (PLC), or a similar device that may be adapted to receive, store, and manipulate the signals received from sensors in system 10. Control unit 42 may be Allen Bradley control unit provided by Rockwell Automation, or its equivalent. Control system 40 may also include a user interface (U/I) 43 through which an operator can input parameters or desired operating modes to regulate the operation of control system 40 via electrical connection 45 and receive output, for example, operating parameters, from control system 40.

As shown in FIG. 1, control unit 42 may monitor and control the operation of motors 28 and 30 that drive conveyors 22 and 24, respectively. Controller 42 communicates with motor 28 via electrical connection 44 and with motor 30 via electrical connection 46, for example, by means of a 4-20 mA signal or a 0 to 1 VDC signal. Though electrical connections may be shown hardwired in FIG. 1 and elsewhere, it will be understood that these connections may also be wireless, for example, RF or Bluetooth-type wireless communication. Control unit 42 also monitors at least one speed detector 50 adapted to detect the speed of conveyor 14, that is, the speed of transfer of signatures 13 along conveyor 14. Speed detector 50 may be any detector adapted to detect the speed of conveyor 14 and output an electrical corresponding to the speed of conveyor 14. Control unit 42 communicates with speed detector 50 via electrical connection 48. Speed detector 50 may be proximity sensor, an encoder (for example, an encoder mounted to motor 20 which drives conveyor 20), or any other sensor adapted to detect the speed of transfer of signatures on conveyor 14.

Control system 40 may also include one or more sensors 52 adapted to detect the thickness of signatures 11 being handled by system 10. Sensors 52 may be positioned anywhere in system 10, and typically are located near conveyor 22 or 24, for example, where signatures 11 are being introduced to system 10. Sensor 52 may be proximity sensor, for example, analog proximity sensor, a linear variable displacement transducer (that is, an LVDT), or any sensor adapted to detect a thickness, for example, a relative thickness of signatures 11. As will be discussed below, the operation of system 10 may vary depending upon whether "thick" or "thin" signatures 11 are being handled. The thickness of the signatures may also be entered manually through user interface 43. Sensor 52 communicates with control unit 43 via electrical connection 53.

Control system 40 may also include one or more sensors 54 adapted to detect the height of signatures 11 in hopper 26, for example, to determine where further signature can or should be introduced to hopper 26. Sensors 54 may be positioned to adjacent to hopper 26, as shown, or anywhere near hopper 26 to detect the height or presence of signatures 11. In one aspect, signatures 11 in hopper 26 may be detected by a load or pressure sensor. In one aspect, sensor 54 may be a photoelectric sensor, for example, a photo eye, adapted to sense the present or absence of signatures 11 at a given elevation. In one aspect, the operation of conveyor 22 and/or conveyor 24 may be operated in response to sensor 54, for example, conveyor 22 and/or conveyor 24 may only operate when sensor 54 indicates that hopper 26 can receive signatures 11. Sensor 54 communicates with control unit 43 via electrical connection 55.

In one aspect, control system 40 is adapted to control the speed of the variable speed drive system associated with motor 28, the variable speed drive system associated with motor 30, or both in response to the speed of conveyor 14, for example, provided by speed detector 50, to minimize misfeeding of signatures. For instance, control system 40 may be adapted to control the speed of conveyor 22 or conveyor 24, or both, proportional to the speed of conveyor 14. For example, when the speed of the conveyor 14, that is, $S_{CC}$, is known, the speed of conveyor 22 or 24, that is, SC, may be controlled to adhere the following relationship:

$$S_C = K \times S_{CC}. \quad \text{Equation 1.}$$

where K is a constant. The constant K may be a function of the thickness, T, of signatures 11 being handled by system 10. For example, when Sc is the speed of conveyor 22 (sometimes referred to as the "infeed conveyor"), the value of K may be governed by Equation 2 below.

$$K = S_{MAX1} \times T \times K_1; \quad \text{Equation 2.}$$

where $S_C$ is the speed of conveyor 22, for example, in inches per minute; $S_{CC}$ is the speed of conveyor 14, for example, in cycles per minute (CPM), typically, from about 100 cycles per minute to about 300 cycles per minute; $S_{MAX1}$ is the maximum speed of conveyor 22, for example, in inches per minute, as defined by its drive motor and drive train, typically between about 50 and 100 inches per minute, for example, 68.7 inches per minute; T is the typical thickness of the signatures 11, for example, in inches; and $K_1$ is a constant which is system specific. The value of $K_1$ may range from about 0.1 to about 100, but is typically between about 3.0 and 10. The value of $K_1$ may also vary as a function of the thickness of signatures 11 being handled, for example, when the thickness of signatures 11 is less than 0.25 inches, that is, a "thin" signature, the value of $K_1$ may have first value, and when the thickness of signatures 11 is greater than or equal to 0.25 inches, that is, a "thick" signature, the value of K1 may have a second value different from the first value. For example, by combining the relationships defined in Equations 1 and 2 and assuming a value of $K_1$ of 3.9, the speed of conveyor 22, that is, $S_C$, may be controlled according to the relationship shown in Equation 3 to minimize misfeeding.

$$S_C = S_{MAX1} \times T \times 3.9 \times S_{CC} \quad \text{Equation 3.}$$

When Sc is the speed of conveyor 24 (sometimes referred to as the "incline conveyor"), the value of K may be governed by Equation 4 below.

$$K = S_{MAX1} \times K_2; \quad \text{Equation 4}$$

where $S_{MAX1}$ is the maximum speed of conveyor 24, for example, in inches per minute, typically between about 500 and 1000 inches per minute, for example, 634 inches per minute; and $K_2$ is a constant which is system specific. The value of $K_2$ may range from about 0.1 to about 100, but is typically between about 3.0 and 10. The value of K2 may also vary as a function of the thickness of signatures 11 being handled, for example, when the thickness of signatures 11 is less than 0.25 inches, that is, a "thin" signature, the value of $K_2$ may have a first value, and when the thickness of signatures 11 is greater than or equal to 0.25 inches, that is, a "thick" signature, the value of $K_2$ may have a second value, different from the first value. For example, by combining the relationships defined in Equations 1 and 4 and assuming a value of $K_2$ of 0.25, the speed of conveyor 24, that is, $S_C$, can be controlled according to the relationship shown in Equation 5 to minimize misfeeding.

$$S_C = S_{MAX1} \times T \times 0.25 \times S_{CC} \quad \text{Equation 5.}$$

In some instances the speed of conveyors 22 and 24 as dictated by equations 1-5, may be too low to have signatures 11 transferred properly or may cause overheating of drive motors 28 and 30. Therefore, since in one aspect system 10 is intended to operate automatically, a minimum speed for conveyors 16, 22, and 24 may be set to avoid misfeeds and motor failure. For example, a minimum speed of 100 cycles per minute may be set for conveyor 16 and the minimum speed of 10% of the maximum speed of conveyors 22 and 24 may be provided.

Figure 2:
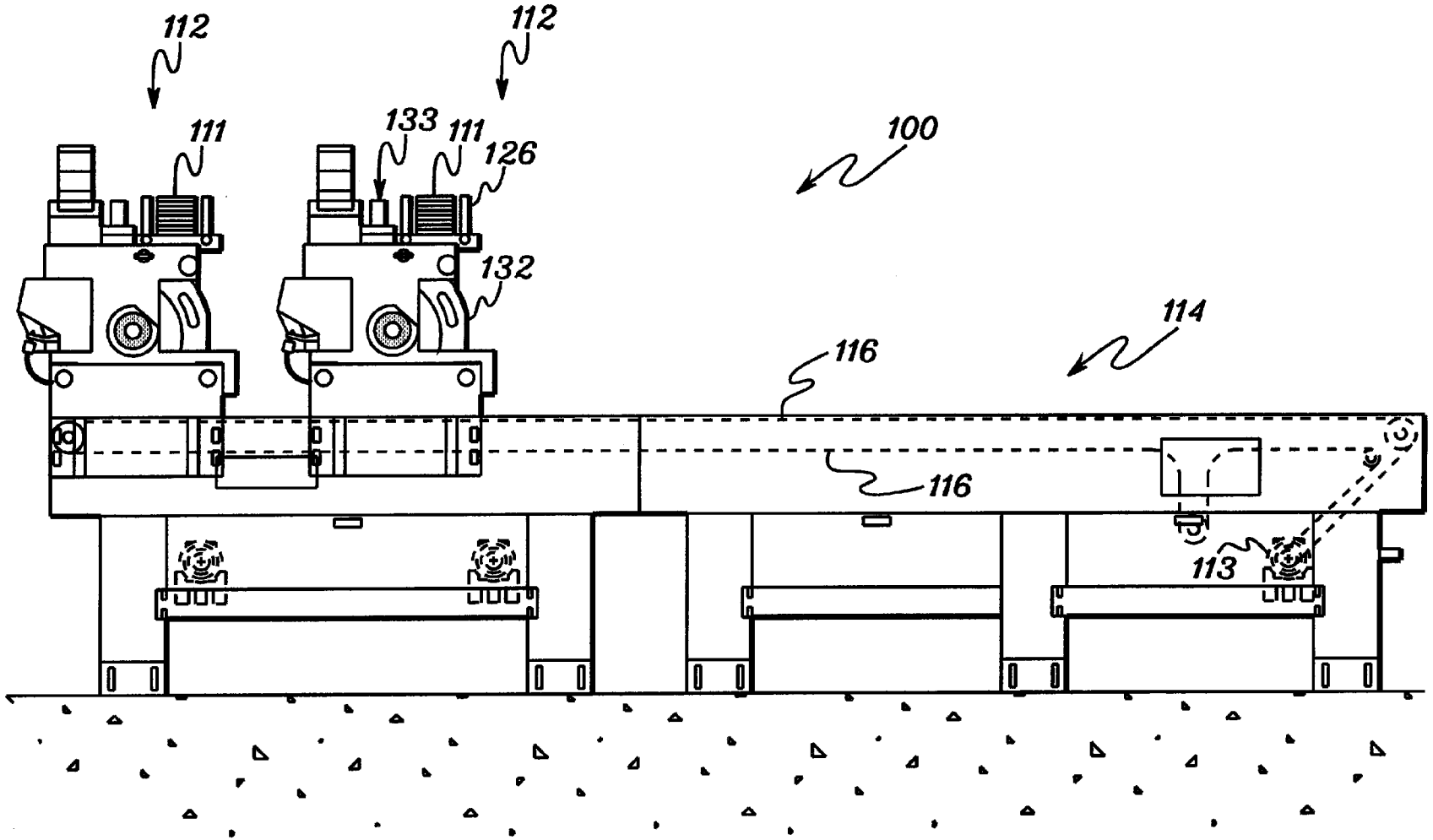
FIG. 2 is a front elevation view of a collating conveyor and signature feed system employing aspects of the invention shown in FIG. 1.

FIG. 2 is a front elevation view of a signature handling system 100 having a collating conveyor 114 and one or more signature feed systems 112 employing aspects of the invention shown in FIG. 1 for handling signatures 111. For example, conveyor 114 may correspond to conveyor 14 in FIG. 1 and feed system 112 may correspond to feed system 12 shown in FIG. 1. Conveyor 114 may be a collating conveyor, for example, a collating conveyor provided by Prim Hall Enterprises and includes a conveyer belt or chain 116. Each signature feeder system 112 includes a rotatable feed drum 132, a signature hopper 126, and a separator disk servomotor 133. Signature feeder system 112 may correspond to system 12 shown in FIG. 1 and feed drum 132 may correspond to drum 32 shown in FIG. 1. As is known in the art, feeder 112 is adapted to separate signatures 111 from the hopper 126 and feed signatures 111 to conveyor 114.

According to aspects of the invention, conveyor 114 typically includes a conveyor belt 116 that conveys the signatures 111 whereby the signatures 111 are transferred to the desired destination, for example, to a binding machine. Chain 116 is typically driven by one or more sprocketed chain drive motors 113 and chain 116 is passed over two or more sprockets as shown in FIG. 2, as is typical in the art.

As shown in FIG. 2, feeder 114 may include a means for separating individual signatures 111 from the stack of signatures in hopper 126, for example, a "sucker arm," and a rotatable separator disk, or disk separator (not shown), for instance, as shown in U.S. Pat. No. 6,623,000. The separator disk is typically mechanically driven by variable speed motor or servomotor 133. Servomotor 133 typically rotates the separator disk at a variable speed to separate individual signatures 111 from the stacked signatures in hopper 126 and deliver the separated signatures 111 to drum feeder 132 which feeds conveyer 114. As is conventional, for example, as described in U.S. Pat. No. 6,193,229 (the disclosure of which is incorporated by reference herein), when the separator disk rotates to separate a signature 111 from the stacked signatures from hopper 126, the sucker arm employs a vacuum to draw one end of the separated signature 111 from hopper 126 and position the signature 111 on or adjacent to feed drum 132. Feed drum 132 is typically driven by a motor (not shown). Feed drum 132 typically includes a plurality of "grippers" (not shown) and feed drum 132 rotates the grippers into a gripping position with respect to the separated signature 111. When signature 111 is positioned by the sucker arm, the gripper grips the separated signature 111 whereby further rotation of feed drum 132 delivers the separated signature 111 to conveyer 114. The grippers are configured to release signature 111 when signature 111 is in a position to be deposited onto conveyor 114.

Figure 3:
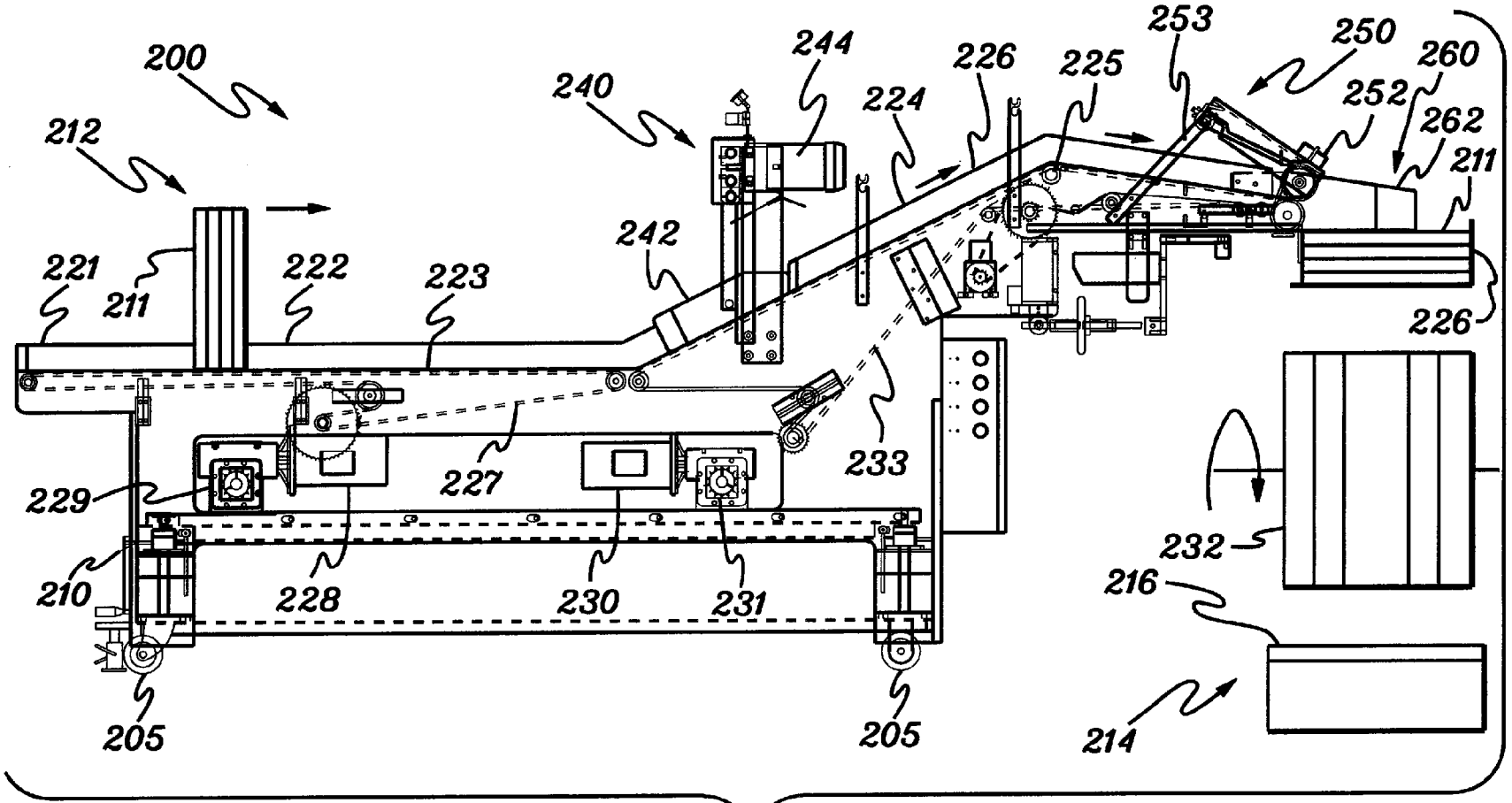
FIG. 3 is a side elevation view of an automated conveying system according to another aspect of the invention.

According to aspects of the invention, signatures 111 may typically be fed to hopper 126 by at least one conveyor, for example, by a feed system similar to feed system 14 having conveyors 22 and 24 as shown in FIG. 1. FIG. 3 is a side elevation view of an automated signature feeding system 200 that may also be used to introduce signatures 111 to hopper 126 in feed system 114 shown in FIG. 2 according to another aspect of the invention.

As shown in FIG. 3, signature feed system 200 includes a conveyor system 212 having at least one, but typically two, conveyors 222 and 224 adapted to feed signatures 211 to a hopper 226 for subsequent transfer to conveyor 216 by means of a disc separator (not shown) and transfer drum 232. Conveyors 222 and 224 may be mounted on a common support structure 210, for example, a transportable structure having wheels 205. Conveyor 214 having belt 216 may be similar to conveyor 14 shown in and described with to FIG. 1 or conveyor 114 shown in and described with respect to FIG. 2, for example, a collating belt conveyor. Drum conveyor 232 may be similar to drum conveyor 132 shown in and described with respect to FIG. 2 and hopper 226 may be similar to hopper 26 shown in and described with reselect to FIG. 1 or hopper 126 shown and described with respect to FIG. 2.

As shown in FIG. 3, conveyor 222 (which is referred to in the art as an "infeed conveyor") receives signatures 211, typically standing on end as shown, and transfers signatures 211 to conveyor 224. Conveyor 222 includes one or more guide rails 221 and a conveyor belt 223 which is driven by motor 228 through gear box 229 (for example, having a 60:1 gear ratio) which drives a chain 227 mounted on sprockets, as is conventional. However, according to aspects of the invention, motor 228 and gear box 229 are adapted to vary the speed of conveyor belt 223 as a function of the speed of belt 216 of conveyor 214 to minimize or eliminate misfeeds of signatures 211, for example, in response to the relationships defined in Equations 1 through 5 above.

Similarly, conveyor 224 (which is referred to in the art as an "incline conveyor") receives signatures 211 from conveyor 222 and transfers signatures 211 to hopper 226. Conveyor 224 includes one or more guide rails 226 and a conveyor belt 225 which is driven by motor 230 through gear box 231 (for example, having a 20:1 gear ratio) and drive chain 233 mounted on sprockets, as is conventional. However, according to aspects of the invention, motor 230 and gear box 231 are adapted to vary the speed of conveyor belt 225 as a function of the speed of belt 216 of conveyor 214 to minimize or eliminate misfeeds of signatures 211, for example, in response to the relationships defined in Equations 1 through 5 above.

As also shown in FIG. 3, feed system 200 may include a signature jogging or vibrating device 240 adapted to agitate signatures 211 as they are mounted on conveyor 224, for example, to minimize misfeeds. Jogging device 240 typically includes a jogging plate 242 driven by jogging motor 244, for example, via one or more cams and linkages, as is conventional, to oscillate jogging plate 242 and agitate signatures 211. The jogging or agitation of signatures 211 by jogging device 240 promotes alignment or settling of signatures 211 on conveyor 224. In the art of the invention, jogging device 240 may be referred to as a "nose jogger."

Feed system 200 may also include a device 250 adapted to assist in transferring signatures 211 from conveyor 224 to hopper 226. Device 250 typically includes a driven wheel 252 adapted to contact signatures 211 and propel signatures 211 into hopper 226. Driven wheel 252 is referred to in the art as a "speeder wheel" and typically comprises a cylinder or rollers having an elastomeric outer surface, for example, a rubber, that provides friction between the surface of speeder wheel 252 and the surface of signatures 211. Speeder wheel 252 may be driven by a dedicated motor (not shown), a drive chain 253, and appropriate sprockets, as is conventional. In some aspects of the invention, the speed of speeder wheel 252, that is, $S_{SW}$, may be regulated as a function of conveyors 222, 224, or 216, or a combination thereof, for example, to minimize or prevent misfeeds of signatures to hopper 226. For example, the control system 40 (see FIG. 1) may be adapted to control the speed of the speeder wheel, $S_{SW}$, proportional to the speed of conveyor 222 or conveyor 224. As will be discussed below, the relationship between the speed of the speeder wheel 252 and the speed of conveyor 222 or 224 may be a function of the thickness of the signature 211 being handled.

Feed system 200 may also include a jogging or vibrating device 260 adapted to agitate signatures 211 as they are fed to hopper 226 or while the signatures 211 are loaded in hopper 226. Jogging device 260 typically includes a jogging plate 262 driven by a jogging motor (not shown), for example, via one or more cams and linkages, as is conventional, to oscillate jogging plate 262 and agitate signatures 211. The jogging or agitation of signatures 211 by jogging device 260 also promotes alignment or settling of signatures 211 in hopper 226. In the art of the invention, jogging device 260 may be referred to as a "hopper jogger."

Aspects of the present invention may also include one or more jets (not shown) of pressurized gas, typically, air, used to agitate, convey signatures, or otherwise "condition" the signatures for proper handling. These pressurized jets of air may be provided by means of flexible hoses, as is typical in the art. The direction of the jets may be adjusted manually by the operator or by means of automatic actuators. The air jests are typical located where signatures encounter transitions, such as, in the vicinity of the transition from conveyor 222 to conveyor 224 or from conveyor 224 to hopper 226, though these jets of air may be positioned wherever needed to promote the flow of signatures 211 or minimize or prevent misfeeds.

Feed system 200 typically includes an integrated control system 40 and a controller 42 shown in and described with respect to FIG. 1, including the detection of the speed of conveyor 216, for example, by means of one or more speed sensors 50 (See FIG. 1). Control system 40 typically may be used to vary the speed of operation of conveyors 222 and 224, jogging device 240, and speeder wheel 252 to minimize or prevent the misfeeding of signatures 211 and thus increase performance and throughput of system 200.

According to aspects of the invention, system 200 may be operated in a variety of modes depending, for example, upon the nature of the signatures being handled. For example, system 200 may be operated in thick signature mode (also known as "thick shingle" mode) or in thin signature mode (also known as "thin shingle" mode). In thick shingle mode, that is, when signatures 211 are typically greater than or equal to 0.25 inches in thickness, signatures 211 typically cascade from conveyor 224 into hopper 226. This mode of operation is typically used for signatures that "roll out" of conveyor 224 into hopper 226, for example, high-page count, flimsy products like "TV Guide"; signatures that are "sticky," for example, due to having excessive ink or static; signatures having small leaves attached that do not sit flat on the signature; and three-sided, open, flimsy, high-page count signatures, such as "Newsamerica". In thick shingle mode, the rotational speed of the speeder wheel 252 is controlled as a function of the speed of incline conveyor 224 (for example, as determined from Equations 1-5); specifically, the surface speed of speeder wheel 252 is typically controlled to the surface speed of belt 225 of conveyor 224.

In thin shingle mode, for example, for signatures less than 0.25 inches in thickness, signatures 211 are transferred from conveyor 224 to hopper 226 in a thin flow. In thin shingle mode, speeder wheel 252 may be used to transfer the signatures to hopper 226. Thin shingle signatures may also require jogging while being transfer to or while in hopper 226, for example, by hopper jogger 260. In addition, when thin shingles are being handled a jet of air may be provided during transfer to hopper 226 and even while the thin shingles are loaded in hopper 226 to enhance subsequent transfer to drum feeder 232. In thin shingle mode, the rotational speed of the speeder wheel 252 is typically independent of the speed of incline conveyor 224, and may be set as a percentage of the max speed of speeder wheel 252 as defined by its motor and drive train, for example, about 40% of the max speed. In thin mode, speeder wheel 252 may continue to rotate even though conveyor 224 has stopped, for example, to ensure that signatures 211 are transferred to hopper 226.

One or more further modes of operation may also be provided. For example, a "thin 2" mode may be provided where, similar to "thin mode," the speed of speeder wheel 252 can be operated independently, but the hopper jogger 260 and air jets continue to operate after conveyor 224 stops moving.

Based upon the foregoing description, it will be understood that prior to or during operation of systems 10, 100, and 200, certain parameters may typically be input or set in order to ensure proper operation. First, the thickness of the signatures 11, 111, 211 being handled is input, for example, through user interface 43 (FIG. 1). The thickness of signatures may range from about 0.0625 inches to about 5 inches. This thickness defines the speeds, $S_C$, of the infeed conveyor 22, 222 and the incline conveyor 24, 224 according to Equations 1-5 and the measured speed, $S_{CC}$, of conveyor 16, 216. Equations 1-5 assume that the maximum speed of the respective conveyors are known and can be input to control system 40. The values of constants $K_1$, and $K_2$ in Equations 1-5 are system dependent and are also assumed to be previously input to control system 40 to evaluate Equations 1-5.

Next, the mode of operation, for example, "thick shingle" operation or "thin shingle" operation, may be selected. This selection may be determined by the actual thickness of the signatures, but may also be determined by the type of operation desired by the operator. The type of operation may affect the values of $K_1$ and $K_2$ of the Equations 1-5. The selection of "thick" and "thin" operation may determine the relationship of the speed of infeed conveyor 22, 222, and the incline conveyor 24, 224. For example, in thick shingle operation, the surface speed of the infeed conveyor 22, 222; the surface speed of the incline conveyor 24, 224; and the surface speed of the speeder wheel 252 may be set substantially the same. In thin shingle operation, the surface speed of the infeed conveyor 22, 222 and the surface speed of the incline conveyor 24, 224 may also be set substantially the same, but the surface speed of the speeder wheel 252 may not be related to the speeds of the infeed and incline conveyors. The surface speed of speeder wheel 252 may be independently chosen by the operator in thin shingle mode.

Since control system 40 may typically have the capability to store and recall operating parameters, according to one aspect, one or more custom set ups may be provided and recalled when appropriate. For example, typical set up numbers and their corresponding set up names are listed in Table 1 below.

TABLE 1

Typical Custom Set-ups

| Set-up Number | Set-up Description |
|---|---|
| 0 | No Custom Set-up |
| 1 | 3-sided, open, light-weight stock (e.g., "Newsamerica"), Very thick Shingle |
| 2 | "TV Guide" with stitch on. Very thick Shingle |
| 3 | Rands Super Glossy, 2-page |
| 4 | Specialty Hopper |
| 5 | 775 Hopper Loader |
| 6 | Print-on-demand Feeder |
| 7 | To be determined. |
| 8 | To be determined. |

Other operating parameters that may need to be set or adjusted include: the speed of the nose jogger 240 and the speed of the hopper jogger 260. Though the speed of conveyors 22, 222 and 24, 224 and speeder wheel 252 may be automatically regulated, for example, in accordance with Equations 1-5, system 10, 100, 200 may also be operated "manually" with manual input and adjustment of the speeds of the components.

Some of the advantageous features of systems 10, 100, and 200 according to aspects of the invention include:

- the capability to store and recall operating parameters based upon the type and thickness of signatures being handled allowing faster system set-up and operation
- automatic regulation of the speed of conveyors 222 and 224 and speeder wheel 252 in response to variations in the speed of conveyor 216
- lower temperatures of motors 228 and 230 compared to systems without having automatic motor speed control
- faster speed of operation of motors 228 and 230 (for example, at least about 30% faster) due to minimization for the potential for misfeeds
- automatic operation feed back to operator through user interface 43 (FIG. 1)

While several aspects of the present invention have been described and depicted herein, alternative aspects may be effected by those skilled in the art to accomplish the same objectives. Accordingly, it is intended by the appended claims to cover all such alternative aspects as fall within the true spirit and scope of the invention.

The invention claimed is:

1. A system for loading signatures on to a collating conveyor, the system comprising:

a first belt conveyor;

a second belt conveyor positioned to receive signatures from the first belt conveyor and discharge the signatures to a hopper;

a feeder adapted to transfer signatures from the hopper to the collating conveyor; and a control system adapted to control the speed of at least one of the first belt conveyor and the second belt conveyor proportional to the speed of the collating conveyor to minimize misfeeding of signatures;

wherein the speed, $S_C$, of one of the first conveyor and the second conveyor is proportional to the speed of the collating conveyor, $S_{CC}$, by the following relationship:

$$S_C = K \times S_{CC},$$

wherein $$K = S_{MAX1} \times T \times K_1;$$

wherein $S_{MAX1}$ is the maximum speed of the first conveyor;

T is the typical thickness of the signatures; and $K_1$ is a constant ranging from 0.10 to 10.0.

2. The system as recited in claim 1, wherein the system further comprises:

a hopper jogger adapted to agitate signatures in the hopper;

wherein the control system is further adapted to control the speed of the hopper jogger.

3. The system as recited in claim 1, wherein the system further comprises:

a speeder wheel positioned above the second belt conveyor adapted to discharge signatures from the second belt conveyor to the hopper;

wherein the control system is further adapted to control the speed of the speeder wheel.

4. The system as recited in claim 3, wherein the control system is further adapted to control the speed of the speeder wheel, and wherein the speeder wheel speed, $S_{SW}$, is controlled proportional to the speed of at least one of the first conveyor and the second conveyor.

5. The system as recited in claim 1, wherein $S_C$ is the speed of first conveyor and the typical thickness of the signatures is less than 0.25 inches, and wherein $K_1$ ranges from 3.0 to 10.0.

6. The system as recited in claim 1, wherein $S_C$ is the speed of first conveyor and the typical thickness of the signatures is greater than 0.25 inches, and wherein $K_1$ ranges from 3.0 to 10.0.

7. A system for loading signatures on to a collating conveyor, the system comprising:

a first belt conveyor;

a second belt conveyor positioned to receive signatures from the first belt conveyor and discharge the signatures to a hopper;

a feeder adapted to transfer signatures from the hopper to the collating conveyor; and a control system adapted to control the speed of at least one of the first belt conveyor and the second belt conveyor proportional to the speed of the collating conveyor to minimize misfeeding of signatures;

wherein the speed, $S_C$, of one of the first conveyor and the second conveyor is related to the speed of the collating conveyor, $S_{CC}$, by the following relationship:

$$S_C = K \times S_{CC},$$

wherein $$K = S_{MAX1} \times K_2;$$

wherein $S_{MAX1}$ is the maximum speed of the first conveyor; and $K_2$ is a constant ranging from 0.10 to 10.0.

8. The system as recited in claim 7, wherein $S_C$ is the speed of second conveyor and typical thickness of the signatures is less than 0.25 inches, and wherein $K_2$ ranges from 3.0 to 10.0.

9. The system as recited in claim 7, wherein $S_C$ is the speed of second conveyor and the typical thickness of the signatures is greater than 0.25 inches, and wherein $K_2$ ranges from 3.0 to 10.0.

10. The system as recited in claim 7, wherein the system further comprises:

a hopper jogger adapted to agitate signatures in the hopper;

wherein the control system is further adapted to control the speed of the hopper jogger.

11. The system as recited in claim 7, wherein the system further comprises:

a speeder wheel positioned above the second belt conveyor adapted to discharge signatures from the second belt conveyor to the hopper;

wherein the control system is further adapted to control the speed of the speeder wheel.

12. The system as recited in claim 11, wherein the control system is further adapted to control the speed of the speeder wheel, and wherein the speeder wheel speed, $S_{SW}$, is controlled proportional to the speed of at least one of the first conveyor and the second conveyor.

13. A method for loading signatures on to a collating conveyor, the method comprising:

conveying signatures from a signature loading position using a first conveyor to a second conveyor;

conveying the signatures with the second conveyor to a hopper;

transferring the signatures from the hopper to the collating conveyor; and controlling the speed of at least one of the first conveyor and the second conveyor proportional to the speed of the collating conveyor to minimize misfeeding of signatures;

wherein controlling the speed, $S_C$, of at least one of the first conveyor and the second conveyor proportional to the speed of the collating conveyor, $S_{CC}$, comprises controlling the speed of at least one of the first conveyor and the second conveyor according to the following relationship:

$$S_C = K \times S_{CC},$$

wherein $$K = S_{MAX1} \times T \times K_1;$$

wherein $S_{MAX1}$ is the maximum speed of at least one of the first conveyor and the second conveyor;

T is the typical thickness of the signatures; and $K_1$ is a constant ranging from 0.10 to 10.0.

14. The method as recited in claim 13, wherein the method further comprises agitating the signatures in the hopper.

15. The method as recited in claim 13, wherein conveying the signatures with the second conveyor to the hopper is practiced with a speeder wheel, and wherein the method further comprises controlling the speed of the speeder wheel, $S_{SW}$, proportional to the speed of at least one of the first conveyor and the second conveyor.

16. The method as recited in claim 13, wherein $S_C$ is the speed of the first conveyor and the typical thickness of the signatures is less than 0.25 inches, and wherein $K_1$ ranges from 3.0 to 10.0.

17. The method as recited in claim 13, wherein $S_C$ is the speed of the first conveyor and the typical thickness of the signatures is greater than 0.25 inches, and wherein $K_1$ ranges from 3.0 to 10.0.

18. A method for loading signatures on to a collating conveyor, the method comprising:

conveying signatures from a signature loading position using a first conveyor to a second conveyor;

conveying the signatures with the second conveyor to a hopper;

transferring the signatures from the hopper to the collating conveyor; and controlling the speed of at least one of the first conveyor and the second conveyor proportional to the speed of the collating conveyor to minimize misfeeding of signatures;

wherein controlling the speed, $S_C$, of at least one of the first conveyor and the second conveyor proportional to the speed of the collating conveyor, $S_{CC}$, comprises controlling the speed of at least one of the first conveyor and the second conveyor according to the following relationship:

$$S_C = K \times S_{CC},$$

wherein $$K = S_{MAX1} \times K_2;$$

wherein $S_{MAX1}$ is the maximum speed of at least one of the first conveyor and the second conveyor; and $K_2$ is a constant ranging from 0.10 to 10.0.

19. The method as recited in claim 18, wherein $S_C$ is the speed of the second conveyor and the typical thickness of the signatures is less than 0.25 inches, and wherein $K_2$ ranges from 3.0 to 10.0.

20. The method as recited in claim 18, wherein $S_C$ is the speed of the second conveyor and the typical thickness of the signatures is greater than 0.25 inches, and wherein $K_2$ ranges from 3.0 to 10.0.

21. The method as recited in claim 18, wherein the method further comprises agitating the signatures in the hopper.

22. The method as recited in claim 18, wherein conveying the signatures with the second conveyor to the hopper is practiced with a speeder wheel, and wherein the method further comprises controlling the speed of the speeder wheel, $S_{SW}$, proportional to the speed of at least one of the first conveyor and the second conveyor.

* * * * *